US010844568B1

(12) United States Patent
Gupta

(10) Patent No.: US 10,844,568 B1
(45) Date of Patent: Nov. 24, 2020

(54) RAPID CONSOLIDATION AND COMPACION METHOD FOR SOIL IMPROVEMENT OF VARIOUS LAYERS OF SOILS AND INTERMEDIATE GEOMATERIALS IN A SOIL DEPOSIT

(71) Applicant: Ramesh Chandra Gupta, Ashburn, VA (US)

(72) Inventor: Ramesh Chandra Gupta, Ashburn, VA (US)

( * ) Notice: Subject to any disclaimer, the term of this patent is extended or adjusted under 35 U.S.C. 154(b) by 0 days.

(21) Appl. No.: 16/909,581

(22) Filed: Jun. 23, 2020

(51) Int. Cl.
*E02D 5/24* (2006.01)
*E02D 27/16* (2006.01)
*E02D 7/02* (2006.01)

(52) U.S. Cl.
CPC ..... *E02D 5/24* (2013.01); *E02D 7/02* (2013.01); *E02D 27/16* (2013.01); *E02D 2200/1685* (2013.01); *E02D 2250/0007* (2013.01); *E02D 2300/0079* (2013.01)

(58) Field of Classification Search
CPC ..... E02D 3/08; E02D 5/385; E02D 27/18; E02D 2250/0007; E02D 27/32; E02D 3/106; E02D 7/02; E02D 2200/1685; E02D 2250/0023; E02D 27/16; E02D 5/24
See application file for complete search history.

(56) References Cited

U.S. PATENT DOCUMENTS 1,477,567 A * 12/1923 Lancaster ..... E02D 5/385 405/243
3,184,924 A * 5/1965 Staunau ..... E02D 5/44 405/237
3,772,892 A * 11/1973 Ogawa ..... E02D 3/106 405/171
3,925,998 A * 12/1975 LeCorgne ..... E02D 5/226 405/242
4,126,007 A * 11/1978 Mars ..... E02D 3/08 405/240
4,165,198 A * 8/1979 Farmer ..... E02D 5/385 405/222
4,451,175 A * 5/1984 Yamashita ..... E02D 3/10 383/1
7,604,437 B2 * 10/2009 Wissmann ..... E02D 3/08 405/232
2004/0258486 A1 * 12/2004 Otsuka ..... E02D 3/10 405/231
2008/0101873 A1 * 5/2008 Fox ..... E02D 3/08 405/239

(Continued)

*Primary Examiner* — Carib A Oquendo

(57) ABSTRACT

The rapid consolidation and compaction method comprises (i) first driving a hollow pipe, (ii) driving a pipe with a removable end plate after filling and compacting the sandy material in it, through the hollow pipe, to required depth, creating high excess pore-water pressures in the range of 50 to 300 KPa in clayey soils, (iv) pulling out the pipe section leaving behind the removable end plate and thereby installing porous displacement piles which allows dissipation of the excess pore-water pressures horizontally to the porous displacement pile, in which the excess water flows out vertically to the ground surface, and (v) the length of the drainage path is reduced to half the spacing between adjoining porous displacement piles, allowing rapid consolidation resulting in increase in density. Installing the porous displacement piles in the layer of loose to medium dense sand layer results in the instantaneous increase in its density.

6 Claims, 10 Drawing Sheets

(56) References Cited

U.S. PATENT DOCUMENTS

| | | | | |
|---|---|---|---|---|
| 2008/0193223 | A1* | 8/2008 | Wissmann | E02D 5/72<br>405/229 |
| 2016/0040384 | A1* | 2/2016 | Wagner | E02D 5/60<br>405/235 |
| 2017/0058477 | A1* | 3/2017 | Niroumand | E02D 27/18 |

* cited by examiner

RAPID CONSOLIDATION AND COMPACION METHOD FOR SOIL IMPROVEMENT OF VARIOUS LAYERS OF SOILS AND INTERMEDIATE GEOMATERIALS IN A SOIL DEPOSIT

TECHNICAL FIELD

This application is for applying for a utility patent in the technical field which includes civil engineering and geotechnical engineering for soil improvement of layers of soils and intermediate geomaterials in the soil deposit. This specification/description is complete-in-itself. This invention is not sponsored or supported by federally sponsored research or development. This invention has been developed by me, Dr. Ramesh Chandra Gupta, Ph. D., P. E, President and Sole Owner of SAR6 INC., solely at my own cost and time. There is no joint research agreement with anyone. As stated earlier, this research/invention was conceived and completed solely by me (Dr. Ramesh C. Gupta, the inventor). It is my individual research work for this invention. The inventor, Dr. Ramesh Chandra Gupta is a Citizen of the United States of America.

BACKGROUND OF INVENTION

Sand drains (Bowles, 1988) are used to consolidate clayey soil layers which cannot support the load of the embankment or foundation structures. A circular casing or mandrel is driven vertically into the soft clayey layer to the required depth. The soil in the casing or mandrel is removed and the hole is backfilled with clean sand. The mandrel or casing is then removed by pulling it out of the ground. The embankment is then constructed up to the full height in stages. If the full height of embankment is 10 meters, then it will develop excess pore-pressures to about 98 kPa only. After allowing sufficient time for consolidation (generally up to 90% consolidation) to complete, the required structure, such as pavement, airport or oil storage tank etc., is constructed up on the embankment. Depending on the horizontal spacing of sand drains and coefficient of consolidation of in-situ clays, the time for consolidation could vary from six months to a year or more. Recently, PVC drains or wick drains have replaced the sand drains; PVC or wick drains are installed by driving, but their volume is so small that it works as the non-displacement pile or element. The invention in this application comprises of a rapid consolidation and compaction method (RCCM) to produce rapid consolidation of the layer of clayey soil resulting in increase of its density and consistency. The RCCM comprises (i) first driving a hollow pipe section to some depth to minimize heave at the ground surface or above the layer of soil requiring improvement, (ii) driving a pipe section with a removable or detachable end plate after filling and compacting the sandy material through the hollow pipe section, to the required depth in the layer of clayey soil, (iii) the pipe section with detachable end plate performs as a displacement pile creating high excess pore-water pressures in the range of 100 to 2500 KPa, depending on the consistency and depth of the clay below ground surface (iv) removing or pulling out the pipe section leaving behind the detachable or removable end plate and thus forming a column of compacted sandy material (which may be named as a porous displacement pile) in the layer of clayey soil and also allowing dissipation of developed excess pore-water pressures horizontally to the porous displacement pile, in which the excess water flows out vertically to the ground surface or to a sandy layer above or below the porous displacement piles, and (v) when the porous displacement piles adjoining to the first one in a grid pattern are installed, the length of the drainage path is further reduced to half the spacing between adjoining porous displacement pile, allowing rapid consolidation of the layer of clayey soil resulting in its increase of density and consistency sufficiently enough to support loads of the required structure, such as pavement, airport or oil storage tank, etc. Installing the porous displacement piles in the layer of loose to medium dense sand layer in a grid pattern results in the instantaneous increase in its density. Therefore, one method of soil improvement (i.e., RCCM) presented in this application as an invention, improves and increases the density of all types of soils and intermediate geomaterials to support loads of the structures of a project. The RCCM does not need an embankment to be built to create excess por-water pressures and the dissipate them through the sand strains or PVC drains.

SUMMARY OF INVENTION

(a) Technical Problem with Existing Geotechnical Methods for Soil Improvement As explained above, widely used method for consolidation and increase in density of the layer of clayey or silty soil is sand drains which have been used since hundreds of years in the past. In fact, this may be the only method which is widely used for consolidation of layers of soft clayey or silty soils to support the loads of a structure. Other methods such as osmosis etc. are rarely used. Recently, several methods have come up which do not increase the consistency or density of the layer of clayey or silty soils, but increase the load capacity by installing (a) Geopiers (Pitt et. Al, 2003), (b) Stone Columns, (c) Jet Grouted Columns, (d) Lime or Cement Mixed Columns with clayey soils in a drilled hole by drilling and auguring or by water jets. Even bottom feed stone columns, which do not use drilled holes does not succeed in improving the density of the layer of the clayey soils, probably because of very strong vibrations by the vibratory probe and inflow clayey soils in them. When holes are excavated using the above methods, a considerable amount of excavated material spreads around the site of the project which has to be properly disposed of to prevent any environmental problem. Reinforced Concrete Piles or H-Piles overtopped by small footing and several layers of geotextile separated by sandy material have been used to support the loads of the embankment on soft to very soft soils; this method does not the density and consistency of soft to very soft soils, but support the weight of road embankment directly, without permitting load on the soft clay layer. These methods are very costly involving millions of dollars per mile (one mile=1.6 Kilometer). There are no historical case histories which may demonstrate their successful long-term behavior.

For compaction of layers of sandy materials in a soil deposit, there are several methods, which are being used, such as dynamic deep compaction by dropping a weight from the selected height, vibro-replacement and vibro-floatation using a Vibro-probe, Geopiers using rammed gravelly materials, stone-columns as bottom feed or top feed, etc.; these methods require special equipment such as Vibro-probe. The rapid consolidation and compaction method using porous displacement piles is a new method which can be used successfully to densify the sandy materials which do not develop excess pore-water pressures or if develops then dissipate as fast as these are generated. The RCCM requires readily available instruments and machinery such as cranes and pile driving hammers etc., pullers, surface or plate vibrators, which are available for renting or leasing at most places.

(b) Solution to Problem and Advantageous Effects of Invention

As explained above, the rapid consolidation and compaction method can be installed to improve density of both sandy and clayey materials. Since the sandy material is very economical with much lower cost as compared to jet grouted columns, columns of cement or lime mixed with clayey material or Geopiers, the cost of using the rapid consolidation and compaction method shall be much lower and could save millions of dollars in a big project. Both the improved in-situ clayey silty material and compacted sandy material in the porous displacement pile shall support load proportionally based on their modulus of elasticity, providing uniform support to the foundation of the structure. No embankment as required for the sand drains or PVC drains and waiting for consolidation to occur for 6 months to more than a year is needed; therefore, progress of construction becomes very fast, which is very important for highway projects for expansion or widening of existing roads and highways.

DETAILED DESCRIPTION OF INVENTION

The main motivation for the invention of the rapid consolidation and compaction method (RCCM) is to develop a method for soil improvement which can densify a layer of the soil or the intermediate geomaterial in a soil deposit. The RCCM consists of installing a porous displacement pile into the layer without excavating a hole, in order to increase density by displacing the in-situ soil (1) in a layer of cohesionless or sandy soil to densify it instantaneously, because in such soils negligible or very small excess pore water pressures develop and dissipate as soon as these develop, and (2) in a layer of cohesive soil, in which installing a porous displacement pile first develops excess pore-water in the range of 50 to more than 2000 kPa in saturated cohesive soil or develops excess pore-water and pore-air pressure in a partially saturated cohesive soils, which then are rapidly dissipated through the porous displacement pile; this method then results in increase of the density and consistency of the cohesive soil layer with dissipation of excess pore water and pore-air pressures. When several adjoining porous displacement piles have been installed in a grid pattern, length of path between the adjoining porous displacement piles for flow of excess water and dissipation of the excess pore-water pressures or pore air-pressures are reduced to very short distance equal to half of the clear spacing between the porous displacement piles; therefore producing the rapid consolidation of the cohesive soils. When footing of a structure is constructed on the soil which has been densified by the RCCM, its weight further creates excess pore-water, which also gets rapidly consolidated and footing may continue to settle uniformly by very small magnitude as the substructure and superstructure is being constructed, but after completion of the superstructure, there shall be hardly any settlement and if any, shall occur uniformly.

Figure 1A:
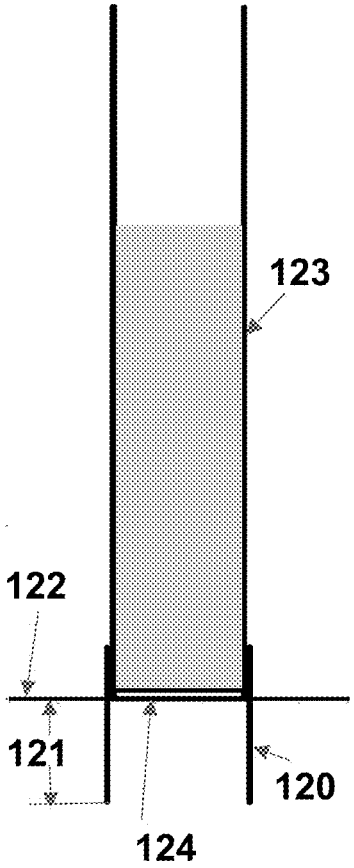
FIG. 1A: A typical detail showing installed non-displacement pile (120) and pipe section (123) with detachable or removable end plate (124) and filled with compacted sandy material.
Figure 1B:
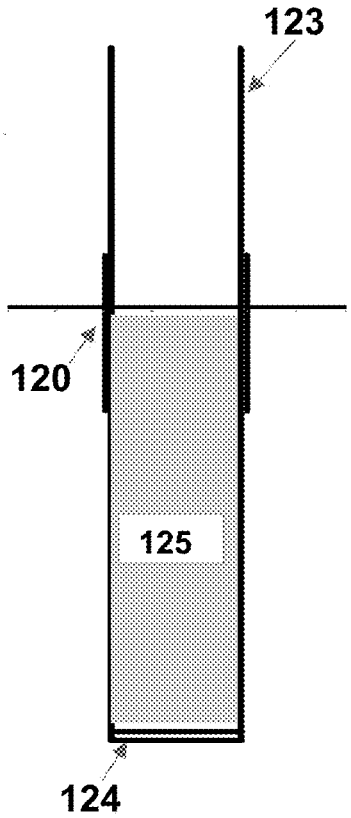
FIG. 1B: A typical detail of pipe section (123) with detachable or removable end plate (124) driven to design depth.
Figure 1C:
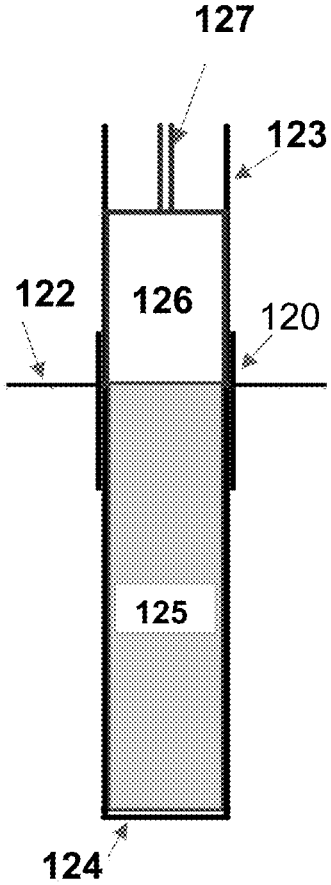
FIG. 1C: A typical detail showing a hammer or weight (126) placed on top of the compacted sandy material (125), prior to pulling the pipe section (123) out of the ground.
Figure 2A:
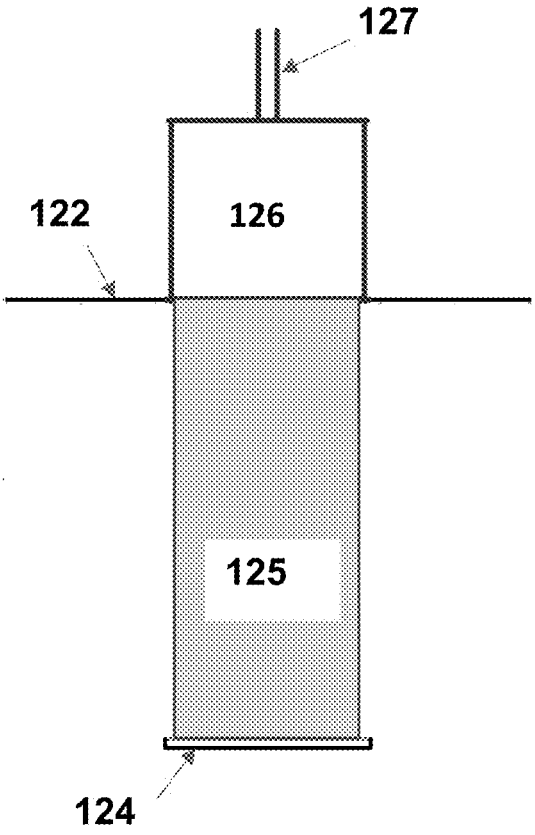
FIG. 2A: A typical detail of the column of compacted sandy material acting as a porous displacement pile (125) after the pipe section has been pulled out of the ground and the hammer or weight (126) still resting on the porous displacement pile (125).
Figure 2B:
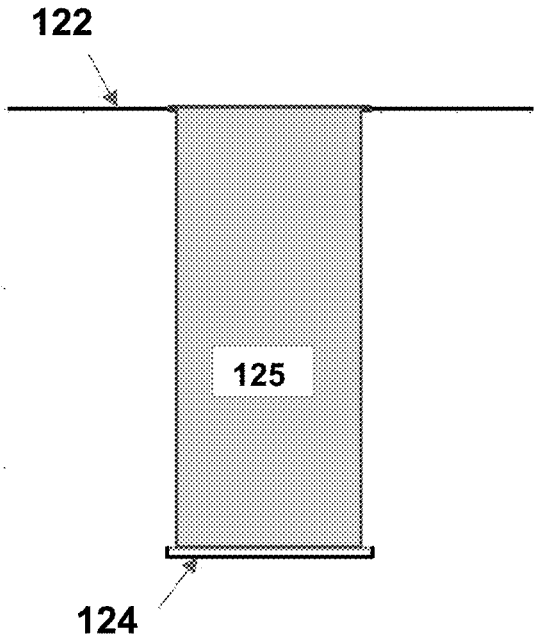
FIG. 2B: A typical detail of completion of installation of the porous displacement pile (125), with end plate (124) sitting under it.

A hollow pipe section (120) is driven into soil to the selected depth (121) to minimize the heave at the ground surface. A hollow pipe sections have very small annular area compared to its outside or inside area, and therefore, for geotechnical purposes, the hollow pipe piles are called non-displacement piles. Similarly, piles consisting of HP-section and channel sections etc. are called non-displacement piles. After the non-displacement pile (120) has been driven into the ground, as shown in FIG. 1A and FIG. 1B, a displacement pile, consisting of the pipe section (123) with a removable end plate (124) and filled with compacted sandy material (125) is driven into the layer to be densified. Since the end plate is attached at the bottom of the pipe section, when driven into ground, it displaces the in-situ soil and occupies its space and thereby densifies it. After placing a weight or hammer (126) on the top of sandy material as shown in FIG. 1C, and the pipe section is pulled out from the ground, leaving behind the detachable or removable end plate at the bottom of the column of the compacted sand, as shown in FIG. 2A. Few drops of weight after raising it by a few centimeters helps in displacing sandy material in the voids created by pulling out the pipe section (123). Thereafter, the non-displacement pile (122) is also pulled out and a few drops of the weight or hammer helps in displacing and compacting sandy material (125) in the voids created by pulling out the non-displacement pile (120). In this way, the porous displacement pile (125) consisting of compacted sandy material, as shown in FIG. 2B, is installed into the ground in the depth, the densification or soil improvement is needed.

The hollow pipe or tube section could be round, square or rectangular or any shape available or made in the industry. Sometimes, two angle sections or two channel sections welded together could also be used as a hollow pipe section. When such sections are attached with a detachable or removable end plate and used as a displacement pile to be driven in to ground, then for geotechnical purposes, it is called a displacement pile as it displaces the soil by occupying its place. When these sections without any end plate at its bottom (i.e. a hollow section) is driven in to ground then for geotechnical purposes, it is called a non-displacement pile. The sandy material can be compacted inside the pipe section at the location where it is to be driven or at the ground other than the location where it is be driven or otherwise in the pipe section after being driven in to ground if the ground below it is sufficiently dense to limit settlement to keep the end plate intact at the bottom of the displacement pile.

The non-displacement pile is driven into the ground first, in order to minimize heave at the ground surface or at the top the layer which is to be densified. Ideally, during driving the displacement pile, there should not be any heave of the ground surface to achieve maximum lateral displacement of the soil by the porous displacement pile, in order to achieve maximum densification. That is why to minimize heave, first a non-displacement pile is driven to selected depth and then the displacement pile is driven through the non-displacement pile. If this step of driving displacement pile through a non-displacement pile is omitted and displacement pile is driven directly, due to economics or for any other reason such as not very practical at a particular site, etc., or when non-displacement pile has not been driven to adequate depth to minimize or prevent heave, then although full densification of in-situ soil would not occur because of some heave at the ground surface; however even then a reasonable amount of densification may occur and in certain circumstances may be considered acceptable. In such cases, the amount of densification will be less as the volume of the in-situ soil displaced by the displacement pile will be sum of the reduction of voids in the in-situ soil plus the volume soil which heaved at the ground surface or at the top of the layer to be densified. The overburden soil above the depth of the bottom of the non-displacement pile (120) acts to prevent or minimize the heave at the ground surface to a reasonable limit, when the weight of the overburden soil above the bottom of the non-displacement pile (120) is sufficient enough to prevent heave at the ground surface. According to the presently available research, the overburden depth between 7 to 10 times or more may be sufficient to limit heave at the ground surface, depending upon the soil conditions. However, not enough or substantial research is available at the present, to predict the reasonable depth (121) in different types of soils at various densities or consistencies to prevent or minimize the heave at the ground surface when a displacement pile is being driven into the ground. Sufficient research shall be developed to predict the reasonable depth (121) in different types of soils at various densities or consistencies, when the projects involving ground improvement using the RCCM are being implemented.

Figure 3A:
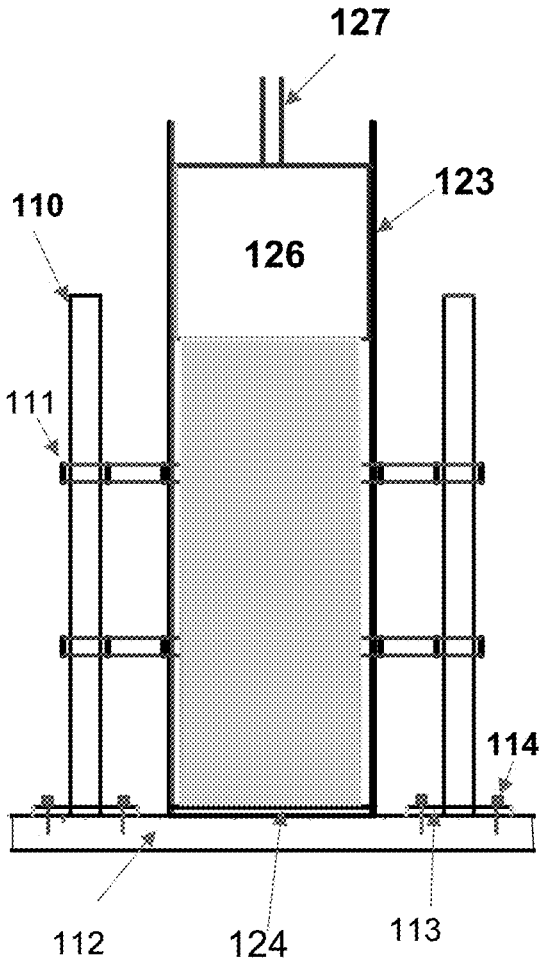
FIG. 3A: A typical detail of a setup to provide lateral support to the pipe section (123) during compaction of the sandy material in it.
Figure 3B:
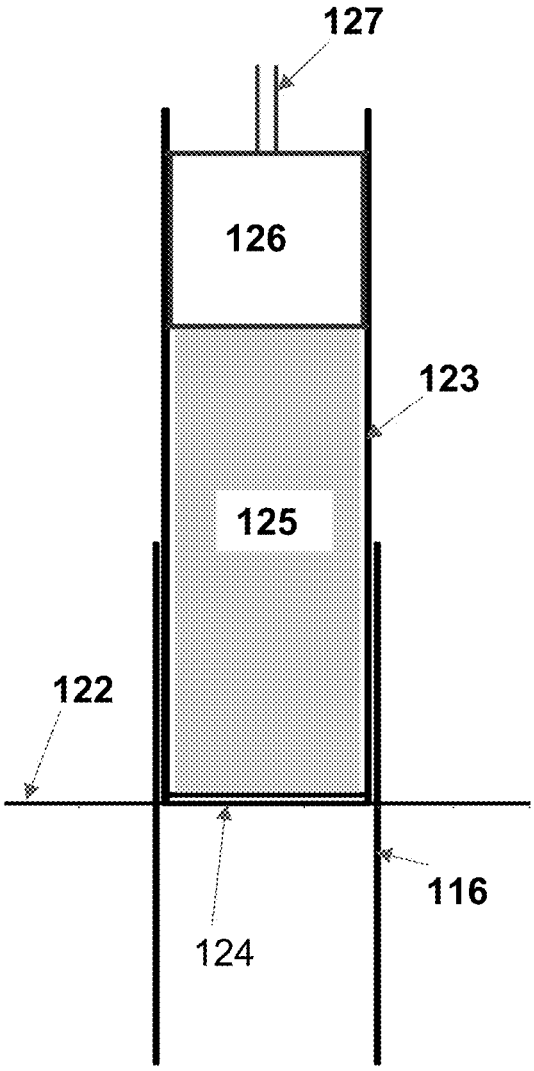
FIG. 3B: Another typical detail of a setup to provide lateral support to the pipe section (123) during compaction of the sandy material in it.

The sandy soil (125) is filled in layers in the pipe section (123) and each layer compacted by a specified number of drops of a hammer or a weight (126) to achieve a specified dry density or relative density. The connecting rod (127) connects the weight or hammer to a boom of crane or to a pile driving hammer system (not shown in the FIG. 1C). Alternatively, the sandy soil can also be filled in layers and then the hammer or the weight (126) is placed on each layer, after which vibrated by attaching a surface vibrator on the sides of the pipe section (123) or on top of the weight, to densify the sandy soil to the specified dry density or relative density. The other method although not very common is to fill sand by pluviation method by screening through various opening size sieves to obtain various densities. Pluviating sand through finer sieve sizes provide higher densities. Another uncommon method is to fill water in the pipe section (123) and slowly fill sandy soil from top of the pipe; because sand settles slowly in water, it achieves higher densities. The pipe section (123) with detachable or removable end plate is generally maintained vertical while filling sandy material in it and compacting it. The density of the compacted sandy material is generally based on equal or greater than 70% relative density, because this is the requirement which is generally followed for compacting embankments. FIG. 3A shows a typical example for the laterally support system to maintain the pipe section (123) in vertical position, which is laterally supported by horizontal braces (111). The horizontal braces are attached to vertical column sections (110) on either side. The column sections are supported on a concrete pad or a plate and fastened into it by nails or bolts (114). Alternatively, the pipe section (123) as shown in FIG. 3B is maintained vertical by slipping it into another pipe section (116) which has already been driven into ground to sufficient depth to remain laterally stable; this pipe section (116) also protrudes out of the ground to maintain the pipe section (123) vertical and laterally stable while compacting the sandy material in it. The lateral support system shall be especially designed at each project depending on the length and size of the pipe section and soil conditions, at which time these typical examples shall also be considered.

There are various types of hammer/weight available to drop on the sandy soil placed inside the pipe section (123) for densifying the sandy soil; any of these hammers/weights can be used when considered appropriate. There are many types of surface vibrators available in the industry which can be used around the pipe to densify sand in the pipe section (123) or placing the vibrator on top of a plate or weight to densify sandy soil inside the pipe; any of the available systems if appropriate can be used. There are many types of pile driving hammers including vibratory hammers available in the industry to drive a non-displacement or displacement pile; any of these driving hammers can be used when considered appropriate. There are many types of pile pipe pullers including vibratory pullers or pullers with hydraulically operated jaws to grab the pile available in the industry to pull the non-displacement or displacement pile out of the ground; any of these pullers can be used when considered appropriate.

Figure 4A:
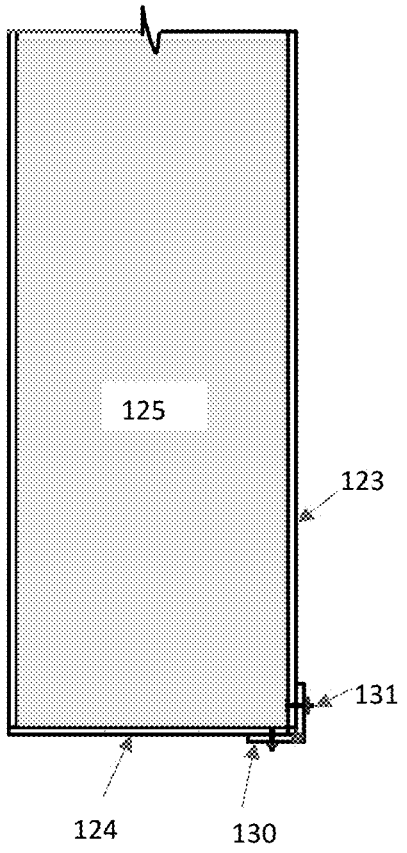
FIG. 4A: A typical detail of the hinged connection connecting pipe section (123) to the removable and detachable end plate (124).
Figure 4B:
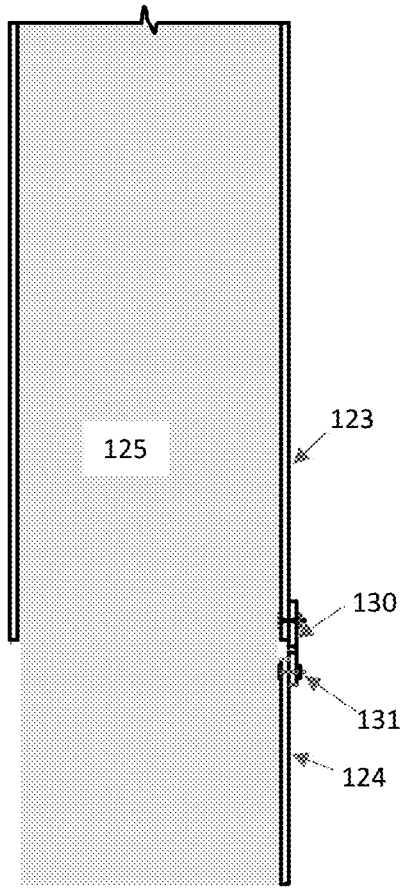
FIG. 4B: A typical detail showing the end plate becoming vertical during pulling the pipe section (123) out of the ground.
Figure 5A:
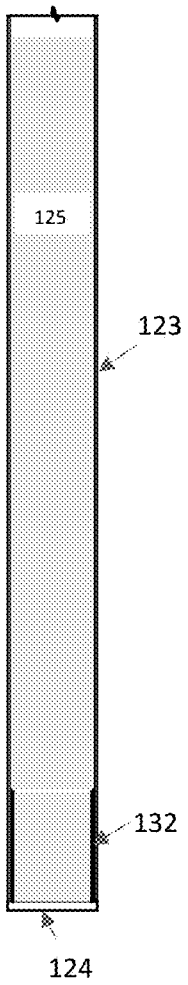
FIG. 5A: A typical detail of the pipe section (123) with a removable and detachable short pipe (132) inserted inside the pipe section (123) where the short pipe (132) is attached to end plate (124).
Figure 5B:
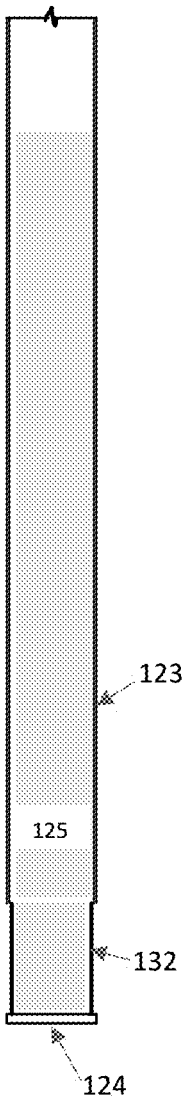
FIG. 5B: A typical detail showing the removable and detachable short pipe (132) and end plate (124) left behind while pulling the pipe section (123) out of the ground.
Figure 5C:
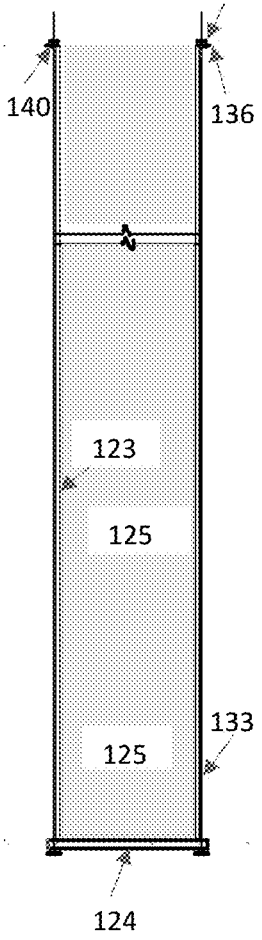
FIG. 5C: A typical detail showing the removable end plate (124) attached to the connecting rods (133); the connecting rods (133) which are fastened by bolts (13%) to the top of the pipe section (123).
Figure 5D:
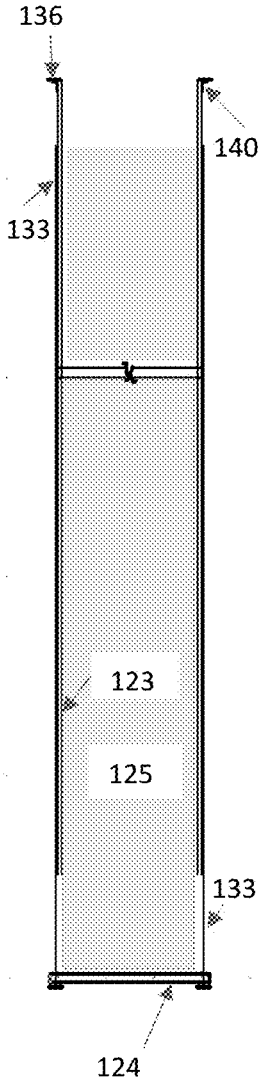
FIG. 5D: A typical detail showing the connecting rods (133) and removable end plate (124), which after removing the bolts (135) are left behind during pulling the pipe section (123) out of the ground.

Few typical examples of detachable or removable end plates are shown in FIG. 4A, FIG. 4B, FIG. 5A, FIG. 5B, FIG. 5C, FIG. 5D, FIG. 6A and FIG. 6B. FIG. 4A shows a detachable end plate which is attached by bolts (131) to a hinge connection (130) on one end to the pipe section (123); during driving the pipe section (123), the detachable end plate (124) remains attached to the bottom, but when pipe section (123) is pulled out of the ground, the detachable end plate (124) connected by the hinge (130) becomes vertical as shown in FIG. 4B, assisting pulling of the pipe section (123) out of the ground, but maintaining the compacted sandy material in place. FIG. 5A shows a short piece of pipe section or a snug corrugated pipe (132) positioned inside the pipe section (123) but attached to the end plate (124). During driving steadily and carefully, a short pipe section (132) and end plate remains in position at the bottom of the pipe section (123), but when the pipe section (123) is pulled out of the ground, the end plate (124) attached to the short pipe or snug corrugated pipe section (132) is left behind in the ground, as shown in FIG. 5B. As an additional option, the section (132) can also be attached by thin aluminum rivets to pipe section (123), but these rivets shall break when weight of compacted sand material exert its weight to break the aluminum rivets. FIG. 5C shows the end plate (124) attached to a plurality of connecting rods (133) which are vertically installed upwards on diametrically opposite locations outside the pipe section (123) and held by bolts (135) near the top of the pipe section (123). The connecting rods (133) pass through a circular plate (136) supported by a plurality of angle sections (140) and fastened by bolts (135) near the top of pipe section (123). During driving the displacement pile, the end plate (124) remain attached, but before pulling the pipe section (123), the bolts (135) are removed and when the section (123) is being pulled out of the ground, the detachable end plate (124) is left behind in the ground as shown in FIG. 5D. In this way the compacted sandy material is left in place forming a porous displacement pile. At each project, the removable or detachable end plate may be especially designed depending on soil conditions and length and size of the displacement piles at which time the above typical examples shall also be considered.

Figure 6A:
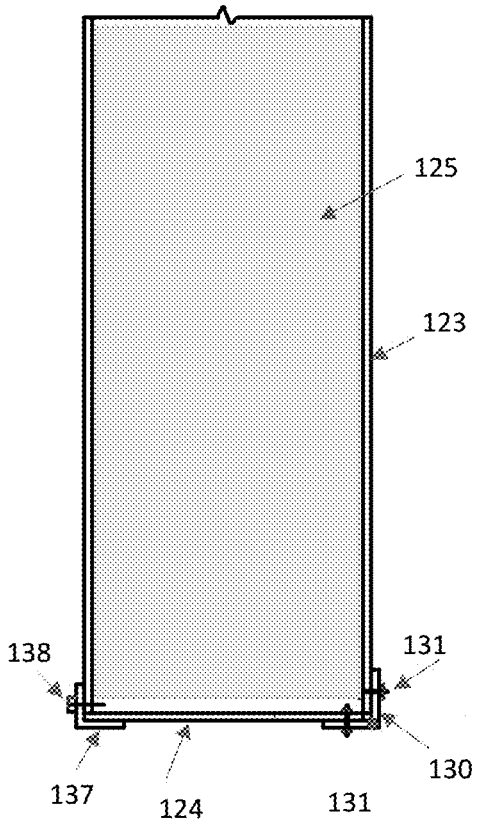
FIG. 6A: A typical detail of removable end plate (124) connected to pipe section (123) with a hinge (130) on one side and on opposite side by an angle (137) which is also bolted to the pipe section (123), for lifting the pipe section (123) filled with compacted sandy material, to a location where it is to be driven into the ground.
Figure 6B:
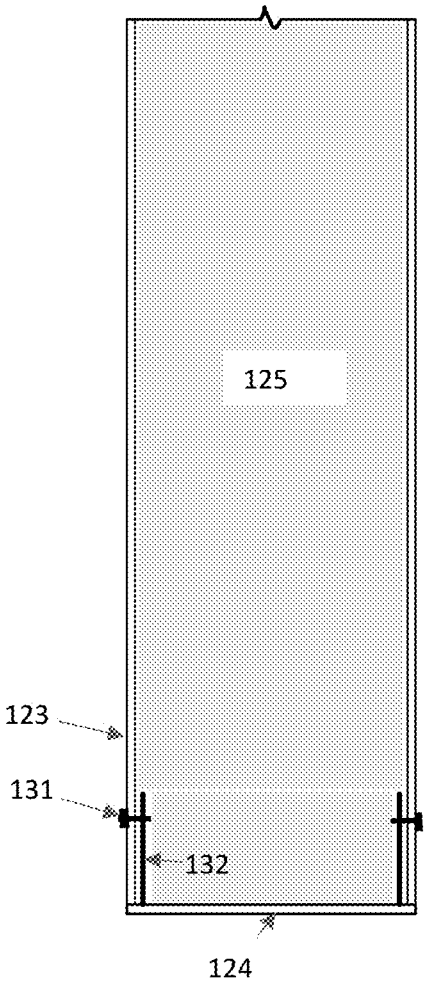
FIG. 6B: A typical detail of pipe section (123) bolted to short pipe section (132) which is attached to the end plate (124) for lifting the pipe section filled with compacted sandy material to a location where it is to be driven into the ground.

The above details are applicable when the field operations to compact the sandy material are being performed at the location where the pipe section (123) is to be driven. When the sandy material is being compacted in the pipe section (123) at some other location and then to be transported to the selected location where it is to be driven in to the ground, the additional attachments to end plate (124) are required. In such cases, the detachable plate arrangement of FIG. 5A and FIG. 5B will still work, but some improvement in FIG. 4A, FIG. 4B, FIG. 5A and FIG. 5B will be needed. As shown, in FIG. 6A, a plurality of angle sections (137) is attached by bolt to the pipe section (123) on diametrically opposite sides to each other and also to the hinged connection (130). FIG. 6B shows the short pipe section (132) attached by a plurality of bolts to pipe section (123) on diametrically opposite sides to each other. When the pipe section (123) has been transported to selected location for driving, it is necessary to remove bolts (138) and slip out the angle sections (137). Similarly, bolts (131) as shown in FIG. 6B has to be removed, when end plate is touching the ground, after which the crane slings be loosened to lower down the displacement pile on the ground.

For pulling the pipe section (123) successfully out of the ground, weight of the weight or hammer kept on top of the compacted sandy material, is designed based on the side frictional resistance developed between the compacted sandy material inside pipe section (123) and side frictional resistance between outside of the pipe section (123) and in-situ soil around it and also any suction force exerted by the in-situ soil on the end plate during pulling of the pipe section. Similarly, weight of the weight or hammer and number and height of drops is designed to achieve the specified density. Although, structural members described for non-displacement and displacement pile consist of circular section as shown in the text and figures, any non-common section of hollow rectangular, or elliptical section or any other non-common section will work with the RCCM and can be used on demand by a client. During driving the non-displacement or displacement pile, sometimes, it becomes important to limit noise and vibrations, in such cases, heavy hammers with very small height drops or hydraulically pushing the piles into the ground may become important so as to minimize or limit the damage or risk to adjoining structures. To monitor settlement of the adjoining structures, the settlement readings both at the structure and at the ground surface and at some depth in the ground may also be made. Also, it may be advisable to perform wave equation analyses for driving the pipe section (123) with a selected hammer. To determine amount of improvement and increase in density of the improved in-situ soils, the subsurface exploration using the in-situ testing methods and laboratory tests on the extracted samples from the in-situ soil may also be performed before and after installation of the porous displacement piles.

The porous displacement pile consisting of the column of compacted sandy material besides densifying and improving soil around it, has another important function to perform, which is to prevent the passage or migration of clay or silty particles into the compacted sandy material while allowing free flow of water through the column of the compacted sandy material in order to dissipate the excess pore-water pressure. The gradation of the compacted sandy material to perform a function of a filter to limit migration of the fine material and allow free flow of water shall be designed based on the design criteria for filters or chimney filters used in earth dams or earth and rockfill dams, using the Terzaghi's criteria with or without some modification made by several organization such as US Bureau of Reclamation, etc. (Prakash and Gupta, 1972). The sandy material may consist of sand and gravel mixture, but should satisfy requirements of allowing free flow of water and to prevent migration of fine particle of in-situ soil into the column of compacted sandy material. Sandy material should not contain more than specified quantity of fine particles in order to maintain its property of free flow of water. Generally, well graded clean sands have been used in sand drains; same type of material could be used for the porous displacement piles.

As an alternative, porous reinforced prestressed concrete piles, or porous pipe section with the end plate, or pipe section with small holes and the end plate, filled by the compacted sandy material can also be used as the porous displacement piles, if (1) drivable by a pile driving hammer into the soil without exceeding allowable driving stresses, (2) allow free drainage and flow of water and prevent migration of fine soil particles of clays and silts, (3) the holes in the tube or pipe section need to be quite small so as to retain sandy material during compaction in the pipe section. These porous displacement piles will not require pulling out of the pipe section out of the ground.

Typical Examples of Industrial Applications of the RCCM

Ground Improvement Under a Spread Footing

Figure 7A:
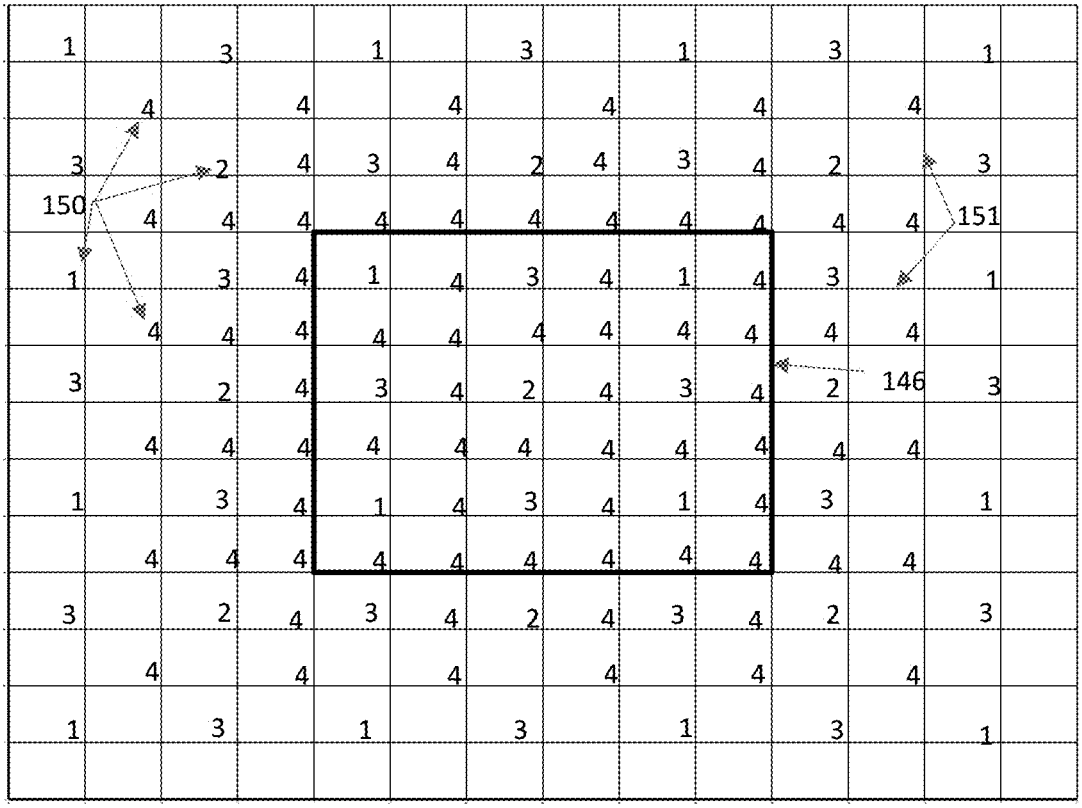
FIG. 7A: A typical plan showing the grid lines (151) and the locations (150) of porous displacement piles for soil improvement under a spread footing.

When a project requires ground improvement of the layer of soil, the RCCM can provide an economical and very useful solution. For example, a spread footing of a bridge foundation is to founded on soil which consists of a week layer of soil (140) and needs soil improvement in order to support the loads from the bridge superstructure. FIG. 7A shows a typical layout plan of the grid lines (151) and location of the center of porous displacement piles (150) consisting of the column of compacted sandy material (125) in a square or rectangular grid pattern. The locations marked by number "1" at the grid intersection (150) are the primary locations where the porous displacement piles shall be installed first, using the method described in the above paragraphs. The locations marked by number "2" at the grid intersection are the secondary locations where the porous displacement piles shall be installed after completing the installation at the primary locations. The secondary locations are usually selected at the center of grid of four primary locations. The locations marked by number "3" at the grid intersection are the tertiary locations where the porous displacement piles shall be installed after completing the installation at the secondary locations. The locations marked by number "4" at the grid intersection are the final and last locations where the porous displacement piles shall be installed after completing the installation at the tertiary locations. A similar arrangement for locations of the porous displacement piles can also be made in a triangular pattern or quadrilateral pattern as is done for vibro-replacement columns, or any other selected grid pattern selected for a particular configuration at a project site.

Figure 7B:
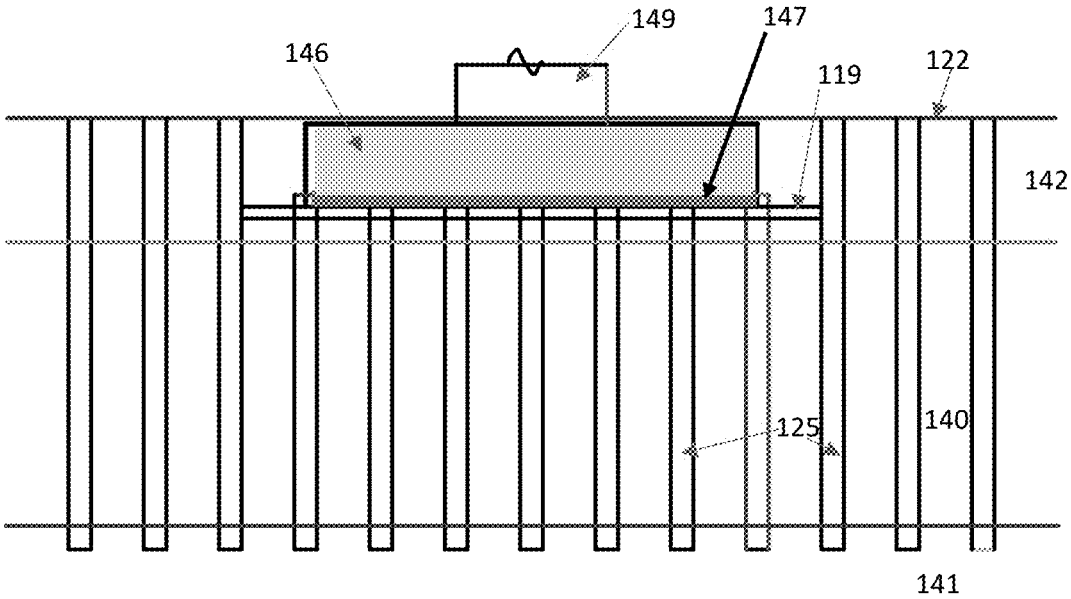
FIG. 7B: Sectional elevation showing the installed porous displacement piles (125) under the spread footing.

FIG. 7B shows a sectional elevation view of the grid pattern shown in FIG. 7A. In FIG. 7B, reinforced concrete foundation (146) has been laid over mud mat (147). The porous displacement piles consisting of compacted sandy materials are installed to the design depth in the layer, which in this case lies in the soil layer (141). CASE 1: Assume top Layer (142) and bottom layer (141) consists of sandy material and the sandwiched layer (140) consists soft clay. In this case the pipe section with detachable end plate can be driven from the ground surface without driving a non-displacement pile first, if the layer (142) is sufficiently thick to reasonably minimize the heave at the top of the weak layer (140), otherwise, it shall be advisable to drive non-displacement pile first and then drive the pipe section (123) with detachable end plate (124) through inside the non-displacement pile. CASE 2: Assume the top layer (142) consists of Clay and the sandwiched layer (140) consists of loose sand and requires densification. In this case, it is advisable to drive the non-displacement pile first to the bottom of the top layer (142) or to some small depth in loose sand layer (140). It shall be advisable to auger out the clayey soil from inside the non-displacement pile and the drive the pipe section (123) with detachable end plate (124) to the design depth. This shall avoid pushing the clayey soil into the loose sand layer, which can prevent instantaneous densification of the loose sand layer. Therefore, at each project, the subsurface soil profile shall be carefully examined and the installation method carefully designed. In some cases, the design may not require installation of porous displacement piles at tertiary (3) or final grid locations (4).

Ground Improvement Under Embankments

Figure 8A:
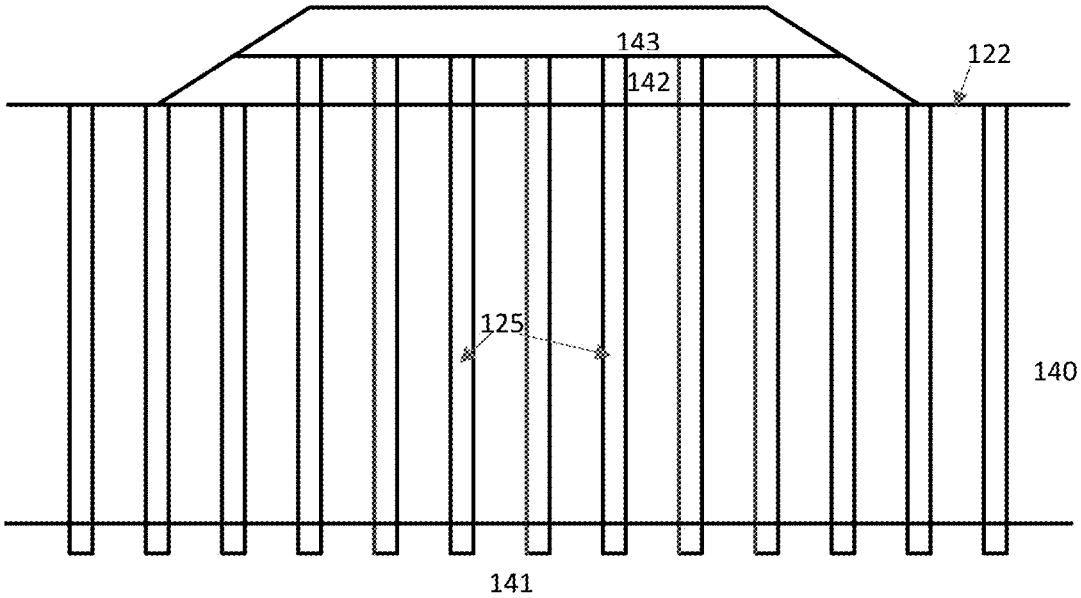
FIG. 8A: A typical detail of the installed porous displacement piles (125) under an embankment.
Figure 8B:
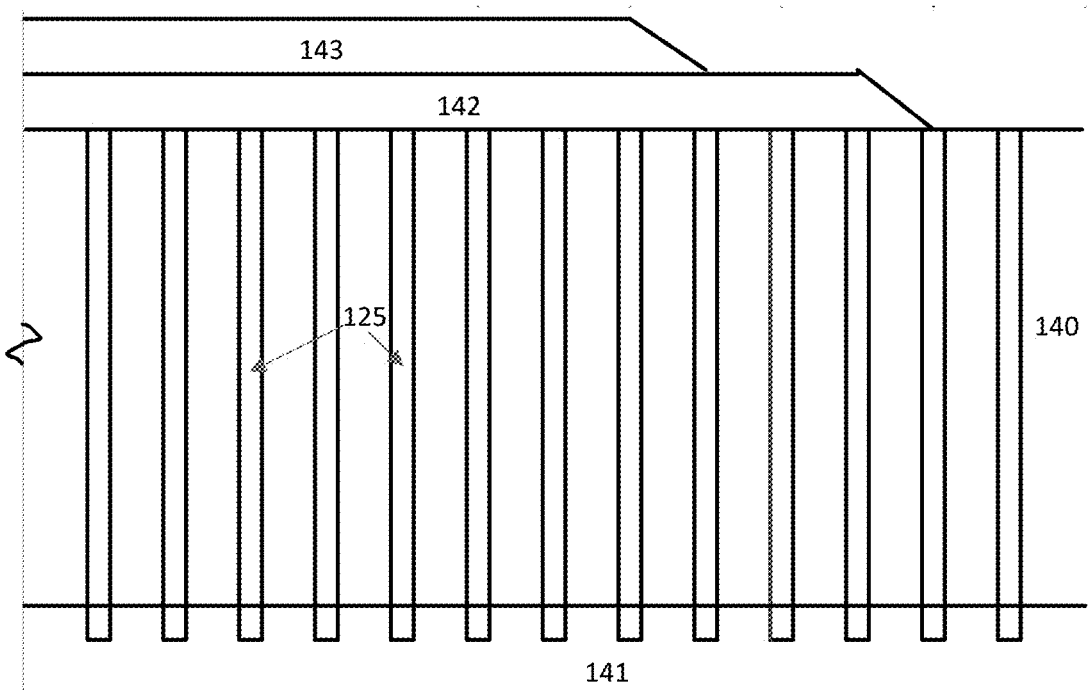
FIG. 8B: A typical detail of the installed porous displacement piles under an embankment with porous displacement piles at primary locations installed ahead of the embankment and the embankment extended on the installed porous displacement piles (125).

The RCCM can be used under mechanically stabilized walls (such as reinforcement earth wall) to reduce and limit their settlements and also to develop required stability. The slopes which are found not to have enough factor of safety based on slope stability analyses when densified by use of the RCCM, shall be able to develop required factor safety for slope failures. The road and highway embankments founded on very soft layers of soils sink and settle sometimes by several inches or feet or meters; and slopes of 2H:1V generally provided on opposite sides of the embankment are found to be unstable, therefore requiring very flat slopes. In such cases the RCCM shall densify the weak or soft soils under the embankments and reduce settlements to the reasonable limits and also improve the slope stability of the embankment slopes without requiring flatter slopes. One typical example is shown in FIG. 8A and FIG. 8B. As shown in FIG. 8A, a layer (142) of sandy material is first laid over very soft clayey soil to build an embankment of low height where the equipment can be brought to install the porous displacement piles consisting of the compacted sandy material. After the installation of the porous displacement piles, the embankment is further raised to full height by additional layers (143). As shown in FIG. 8B, the clayey soil is very weak and it cannot even support the embankment of low height to bring the equipment on it, then the porous displacement piles on primary locations (or even on secondary locations) can be installed ahead of the embankment of low height and then the embankment is extended further and then the porous displacement piles on secondary and tertiary locations can be installed.

The rapid consolidation and compaction method (RCCM) can also be used in coastal regions where embankment is to be further extended into the ocean to build new land for airports and housing projects etc., and where the subsurface soils consist of loose sands and soft to very soft clays. Similarly, new islands can be built even where subsurface soils consist of loose and soft and very soft soils underlies as these subsurface soils can be densified by the rapid consolidation and compaction method. To reduce down drag on the piles driven in clayey and silty soils, the sand drains or PVC (wick) drains are installed and an embankment is built over them to consolidate the clayey silty layer for certain time period for generally up to 90% consolidation and then sometimes the embankment is removed and the piles are driven. In place of sand drains or wick drains, the RCCM to install porous displacement piles can be used, which shall rapidly consolidate the layer without requiring to build an embankment and waiting for up to 90% consolidation. The RCCM can be used very economically for any layer of soils or intermediate geomaterial where soil improvement to densify it is required and also, where ever, presently existing methods such as jet grouted columns, columns of cement or lime mixed with clayey material or Geopiers or vibro-replacement or vibro-floatation using a Vibro-probe, stone-columns as bottom feed or top feed, etc., are being used.

Figure 9:
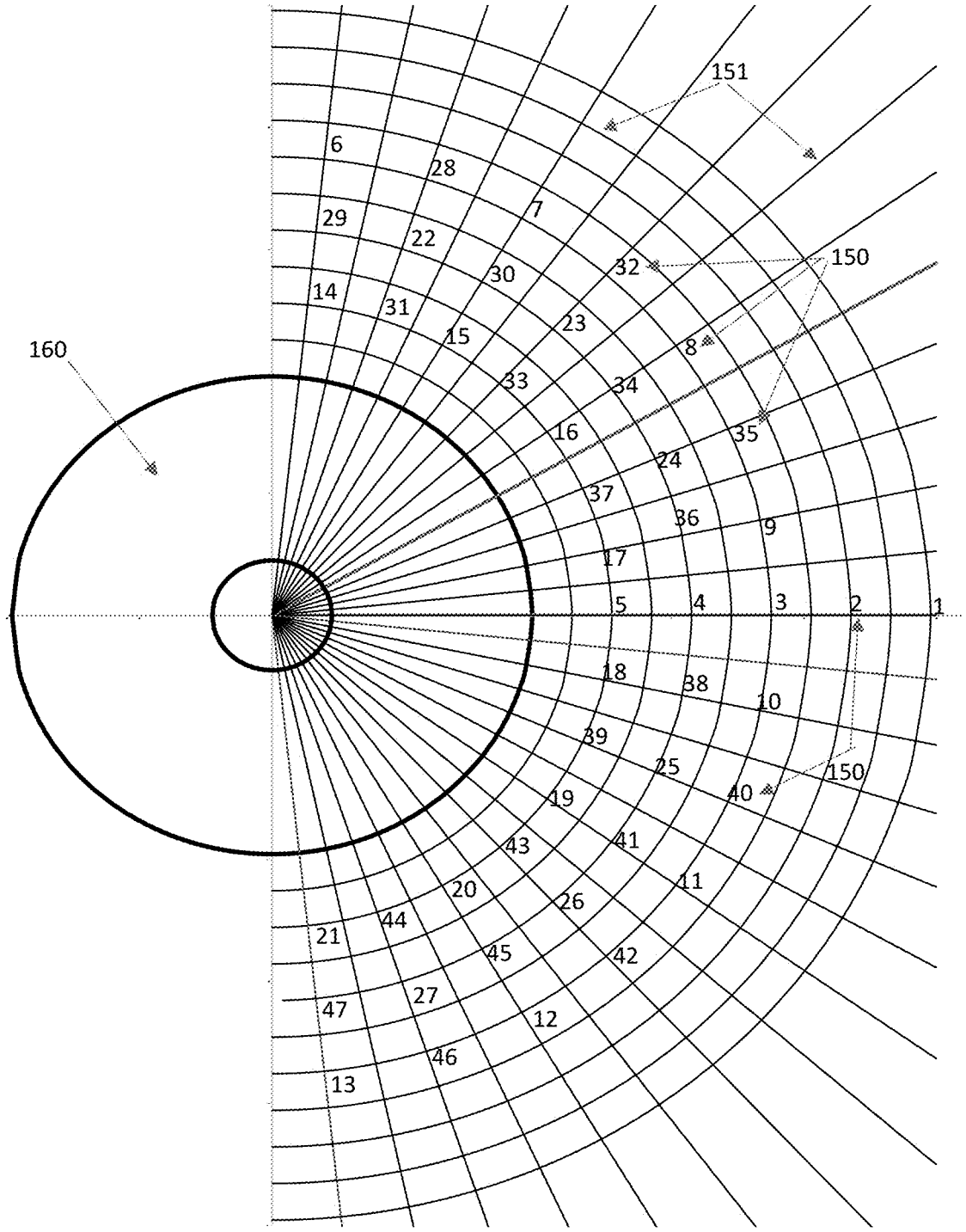
FIG. 9: A typical plan showing the grid lines (151) and the locations (150) of porous displacement piles for soil improvement under and by the side of foundation of the Leaning Tower of Pisa.
Figure 10:
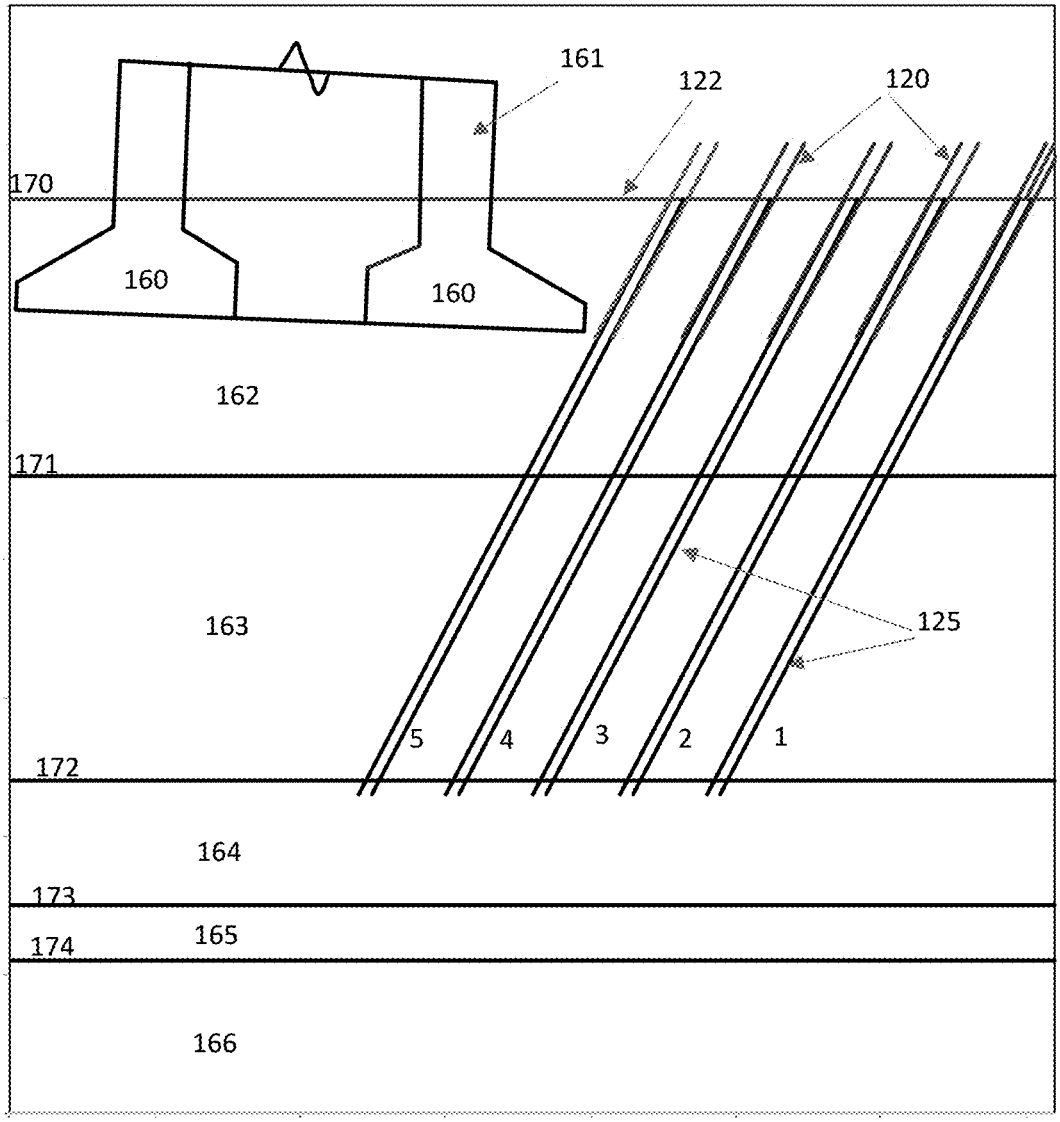
FIG. 10: A typical detail showing foundation of the Leaning Tower of Pisa and subsurface soil layers along with batter Porous Displacement Piles (125).

Ground Improvement Under Tilting or Leaning Structures Such as the Leaning Tower of Pisa There are many structures throughout the world which have tilted either during construction or after completion of the construction. The ground improvement using the rapid consolidation and compaction method for installation of porous displacement piles can improve the foundation soils which will also result in reducing the angle of tilt significantly and bring the leaning structure close to about vertical. There are many other structures in the Town of Pisa, Italy, which are tilting like Leaning Tower of Pisa, but not to this extent. First the porous displacement piles should be installed at other tilting structures of Town of Pisa to demonstrate the effectiveness of soil improvement in succeeding to reduce the tilt with underlying subsurface conditions, before considering to install porous displacement piles at the Leaning Tower of Pisa to reduce the tilt. To reduce the angle of tilt of the Leaning Tower of Pisa, (i) the lead weights have been placed on the north side on prestressed concrete ring around the foundation of the leaning tower of Pisa, (ii) steel cables to anchor the tower on north side to limit movement towards south, (iii) Drill holes installed to remove soil from the drilled holes on the north side, and (iv) some excavation in east-west direction (Jamiolkowsky, et al., 1993). However, no construction on the southside has been permitted and even subsurface exploration consisting cone penetration soundings has been permitted 10 to 20 meters from the south edge of the tower in order not to disturb the tower, although construction as stated above has been permitted on the north side. Prior to installation of porous displacement piles, the additional steel cables to anchor the tower could be considered to further anchor the tower by steel cables in north-east and north-west directions. If permission is granted by the Italian Government and Italian Parliament, the scheme of installation of porous displacement piles as shown in FIG. 9 and FIG. 10 could be worth consideration to consolidate and densify the upper clay (named locally as Pancone Clay) between El. −7 m and −18 m, which has cone penetration resistance, qc, only between 1 to 1.5 MPa (Jamiolkowsky, et al., 1993). The porous displacement piles are proposed to be installed at a batter of about 1V:2H (or even between 1V:3H and 1V:1H), in order to achieve densification of the upper clay (163) and to possibly lift the foundation of the south side of the Leaning Tower of Pisa. When Upper Clay (160) is densified, its bearing capacity shall increase resulting in less settlement on the south side. When the angle of tilt is reduced, the bearing pressure on the south side will reduce and the bearing pressure on the north side will increase, causing more settlement on north side and reducing settlement on the south side of the tower foundation. Also, after stabilizing and densifying the Upper Clay (163), the tendency to further tilt on the south side of the tower foundation in future will be prevented. The following is to demonstrate the industrial application of the ground improvement under a leaning structure to reduce its tilt. For that purpose, the Leaning Tower of Pisa has been selected. Following steps are advisable to implement the scheme:

1. Perform subsurface investigation near the south side of the tower.
2. Install instruments to monitor vibrations and settlements both on ground surface and in selected depths below the ground surface and around the tower above the ground level.
3. Perform radar survey at designated points around the tower above ground level, before and during implementation of the scheme.
4. FIG. 9 shows the grid lines (151) and the locations (150) at grid line intersections, where the porous displacement piles could be installed.
5. FIG. 10 shows: (a) Ground surface elevation as El. 3.0 m (170, (b) elevation of the bottom of Clayey and Sandy yellow silt (162) as El. −7 m (171), (c) the elevation of the bottom of Upper Clay (163) as El. −18 m (172), (d) the elevation of bottom of the Intermediate Clay (164) as El. −22.5 m (173), (e) the elevation of the bottom of the Intermediate Sand (164) as El. −24.5 (173), and (f) Lower Clay (166) underlies the intermediate sand (165).
6. The outside diameter of tower foundation (162) is 19.58 m with 4.5 m diameter circular space in the center. Lower portion of tower is designated as reference number 161 in FIG. 10. Non displacement piles (120) at a batter of 1H:2V are proposed to be driven first up to the bottom level of the foundation of tower. Pile Section (123) with detachable end plate (124) and filled with compacted sandy material shall then be driven through the non-displacement pile (120) to penetrate some small distance in the Intermediate Clay (164). After which the pipe section will be pulled out of the ground followed by withdrawal of non-displacement pile. The porous displacement pile (125) numbering from 1 through 5 have been shown in this figure. Pipe section (123) and detachable end plate (124) has not been shown in this figure.
7. The porous displacement piles at Grid Intersection Location No. 1, which is 15 meters from the south edge of the Leaning Tower, and then at Location No. 2 about 12 meters from the south edge, followed by at Location No. 3 at 9 meters from the south edge, at Grid location 4 at 6 meters from south edge and Grid intersection location no. 5 at 3 meters from the south edge could be installed successively, to monitor and observe the settlement, vibrations and movements etc., continuously and to analyze the effects of installing the porous displacement piles around the tower when their locations get closer to the tower foundations.
8. When recorded data has been analyzed to determine the safety of the tower and when found satisfactory after installation of each porous displacement pile, then only the installation of the remaining porous displacement piles could be considered.
9. If permitted by the authorities, the installation at primary location in the following order could be considered: primary locations 6 through 13, then 14 through 21.
10. After analyzing the data and considered satisfactory to move ahead, then installation at tertiary location in the following order could be considered: Locations 22 through 27, then 28 through 47 could be considered. Tertiary locations could be considered after evaluating the reduction in tilt of the leaning tower.
11. Subsurface exploration to be done to evaluate the improvement of properties of Upper Clay after completion of the construction of porous displacement piles.
12. Although only installing the batter porous displacement piles has been shown in FIG. 10, the vertical porous displacement outside the tower foundation in addition to those shown in FIG. 9 and FIG. 10 could also be installed to improve the density of upper clay outside of the tower foundation. The dispersion of the load of tower or any foundation is considered to occur at a slope of about 60 degrees.

13. Alternatively, in place of the installation of porous displacement piles consisting of compacted sandy material, the porous displacement pile consisting of porous pipe section with attached end plate or pipe sections with holes and containing compacted sandy material and end plate can be considered, as these sections will not need to be pulled out of the ground.

Teachings of this Application

The various aspects of what is described in the above sections, can be used alone or in other combinations for other type of applications. The teaching of this application is not limited to the industrial application described here-in-before, but it may have other applications. Therefore, teaching of the present application has numerous advantages and uses. It should be noted that the teaching of this application is not limited to the industrial applications described in this application. It should therefore be noted that this is not an exhaustive list and there may be other advantages and uses which are not described herein. Although the teaching of the present application has been described in detail for purpose of illustration, it is understood that such detail is solely for that purpose, and variations can be made therein by those skilled in the art without departing from the scope of the teaching of this application. Features described in the preceding description/specification may be used in combination other than the combinations explicitly described. Whilst endeavoring in the forgoing specification/description to draw attention to those features of the invention believed to be of particular importance, it should be understood that Applicant and Inventor claims protection in respect of any patentable feature or combinations of features hereinbefore referred to and/or shown in the drawings/figures whether or not particular emphasis has been placed thereon. The term "comprising" as used in the claims does not exclude other elements or steps. The term "a" or "an" as used in the claims does not exclude plurality. A unit or other means may fulfill the functions of several units or means recited in the claims.

REFERENCES

Bowles, E. B. Foundation Analysis and Design, Fourth Edition, 1981, McGraw-Hill Book Company, New York, N.Y., USA.

Prakash, D., and Gupta, R. C. (1972), "Laboratory Studies on Filter Materials Placed at Ramganga Main Dam," Indian Geotechnical Journal, Vol. 2, No. 3, July 1972, pp. 203-219, New Delhi, India.

Jamiolkowski, M., Lancellotta, R., and Pepe, C. (1993) "Leaning Tower of Pisa-Updated Information", Proceedings, Third International Conference on Case Histories in Geotechnical Engineering, Jun. 1-4, 1993, SOA, St. Louis, Mo., USA.

Pitt, J. M., White, D. J., Gaul, A., and Hoevelkamp, K. (2003). "Highway Applications for Rammed Aggregate Piers in Iowa Soils," Iowa Highway Research Board, Ames, Iowa, USA.

The invention claimed is:

1. A rapid consolidation and compaction method for densifying various layers of soils and intermediate geomaterials in a soil deposit, the rapid consolidation and compaction method comprising:

(i) for rapid consolidation to densify at least one layer of clayey and silty soil and to instantaneously densify at least one layer of sandy soil, a non-displacement pile comprising a pipe section is first driven into ground;

(ii) installing a displacement pile comprising a column of compacted sandy soil, the displacement pile including a pipe section attached with a removable end plate and filled with compacted layers of sandy soil, after filling the pipe section with the compacted sandy soil, the displacement pile is driven into at least one layer of the soil or intermediate geomaterial through the non-displacement pile;

(iii) wherein the displacement pile displaces the at least one layer of clayey and silty soil below the non-displacement pile;

(iv) wherein the displacement pile occupies space previously occupied by the clayey and silty soil and develops excess pore-water pressures in saturated clayey and silty soil and the excess pore-water pressures and the excess pore-water pressures in partially saturated clayey and silty soil;

(v) wherein the displacement pile displaces the at least one layer of sandy soil below the non-displacement pile;

(vi) wherein the displacement pile occupies the space previously occupied by the sandy soil and densifies the sandy soil instantaneously;

(vii) wherein in the sandy soil, the excess pore-water pressures do not develop and if develop, dissipate immediately;

(viii) wherein when the displacement pile has been driven in the ground, a weight or a hammer is placed on top of the compacted sandy soil in the pipe section during pulling the pipe section out of the ground;

(ix) wherein when displacement pile comprising the column of the compacted sandy soil, the pipe section of the displacement pile is being pulled out of the ground, the removable end plate opens 100 percent of inside area the pipe section;

(x) wherein after pulling out of the pipe section out of the ground, the column of the compacted sandy soil is equal to an inside area of the pipe section is installed in the soil;

(xi) wherein the column of the compacted sandy soil after pulling out of the pipe section, behaves as a porous displacement pile;

(xii) wherein the excess pore-water pressures and pore-air pressures developed in the clayey and silty soil are rapidly dissipated through the porous displacement piles to the ground surface or to the at least one sandy layer;

(xiii) wherein the porous displacement piles are either installed vertically or at a batter.

2. The rapid consolidation and compaction method for densifying the various layers of the soils and the intermediate geomaterials in the soil deposit in accordance with claim 1, the rapid consolidation and compaction method further comprising:

(i) wherein the non-displacement pile is driven into the ground first, in order to minimize heave at the ground surface or at top of the layer to be densified;

(ii) wherein, if non-displacement is not driven into the ground and the displacement pile is driven directly, or the non-displacement is not driven to adequate depth to prevent the heave, then the amount of densification will be less as the soil displaced by the displacement pile will be sum of reduction of voids in the soil plus the soil which heaved at the ground surface or at the top of the layer to be densified.

3. The rapid consolidation and compaction method for densifying the various layers of the soils and the intermediate geomaterials in the soil deposit in accordance with claim 1, the rapid consolidation and compaction method further comprising:

(i) wherein the sandy soil is filled in layers and each layer is compacted inside the pipe section;

(ii) wherein either the sandy soil is compacted inside the pipe section at same location where the pipe section filled and compacted with sandy soil is to be driven or at another location other than where the pipe section filled with the compacted sandy soil is to be driven;

(iii) wherein gradation, that is particle size distribution of the compacted sandy material shall be designed to allow free flow of excess water for dissipating the excess pore-water pressures or the excess pore-air pressures and also to prevent migration of fine particles of in-situ soil in to it.

4. The rapid consolidation and compaction method for densifying the various layers of the soils and the intermediate geomaterials in the soil deposit in accordance with claim 3, the rapid consolidation and compaction method further comprising:

(i) wherein the sandy soil is filled in the layers in the pipe section and each layer compacted and densified by drops of the hammer or the weight; wherein a connecting rod connects the weight or the hammer to a boom of crane or to a pile driving hammer;

(ii) or wherein on each layer of the sandy soil filled in the pipe section, the hammer or weight is placed on the top of the sandy soil in the pipe section; wherein then a surface vibrator is attached on side of the pipe section and the pipe section is vibrated to compact and densify each layer of the sandy soil inside the pipe section;

(iii) or wherein on each layer of the sandy soil filled in the pipe section, the hammer or weight is placed on the top of the sandy soil in the pipe section; wherein the hammer or the weight or the hammer is vibrated by a vibrator to compact or densify the sandy soil inside the pipe section;

(iv) wherein the compacted sandy material shall be compacted to achieve relative density between 70 percent and 100 percent;

(v) wherein the pipe section during compaction of the sandy soil is laterally supported to maintain the pipe section in vertical position.

5. The rapid consolidation and compaction method for densifying the various layers of the soils and the intermediate geomaterials in the soil deposit in accordance with claim 1, the rapid consolidation and compaction method further comprising:

(i) wherein the removable end plate is either (a) attached to the pipe section by a hinged connection;

(ii) or (b) by a removable short pipe section connected to the end plate and inserted at the end of the pipe section; wherein as an option the short pipe section is snug to the inside of the pipe section or the short pipe is attached to the pipe section by thin aluminum rivets which break when the pipe section is being pulled out;

(iii) or (c) wherein a plurality of connecting rods bolted to the removable end plate at the bottom of the pipe section and then the connecting rods fastened at the top of the pipe section;

(iv) wherein when the pipe section is being pulled out the ground, (a) the removable end plate hinged to the pipe section becomes vertical for vertical displacement piles or aligns in the direction of batter displacement pile; opening the bottom of the pipe section fully and allows the pipe section to pulled out of the ground without disturbing the column of the compacted sandy soil;

(v) or (b) the short pipe section attached to the removable end plate is left behind at the bottom of the column of the compacted soil when the pipe section is being withdrawn;

(vi) or (c) the bolts at the top of the pipe section are unfastened to allow the connecting rods and the attached removable end plate to disengage with the pipe section; wherein when the pipe section is being pulled out of the ground, the connecting rods and the removable end plate are left in the ground;

(vii) wherein for all these above cases, whichever is selected, after the pipe section has been withdrawn out of the ground, the column of the compacted sandy soil installed in the ground behaves like the porous displacement pile.

6. The rapid consolidation and compaction method for densifying the various layers of the soils and the intermediate geomaterials in the soil deposit in accordance with claim 5, the rapid consolidation and compaction method further comprising:

(i) wherein when the pipe section has been filled and compacted at the location other than that where it is to be driven, then either an at least one angle is bolted to hinged removable end plate and to the pipe section on diametrically opposite side, or at equal spaced points if more than one angle is bolted to the pipe section and the hinged removable end plate;

(ii) wherein after attaching the at least one angle to the pipe section and the removable end plate, the pipe section filled with the compacted sandy material is mobilized to the location where it is to be driven;

(iii) wherein the angle section or the angle sections are removed when the pipe section has been transported to the location where the pipe section is to be driven and when the removable end plate is in contact to the ground, but not resting on it to easily pull out the at least one angle;

(iv) wherein when the pipe section has been filled and compacted at the location other than where it is to be driven, then the short pipe section attached to the removable end plate, is connected to the pipe section by a plurality of the bolts to hold the compacted sandy material in the pipe section in place;

(v) wherein the bolts are removed when the pipe section has been transported to the location where the pipe section is to be driven and when the removable end plate is in contact with the ground.

* * * * *